US008453989B2

(12) United States Patent
Kunishita et al.

(10) Patent No.: US 8,453,989 B2
(45) Date of Patent: Jun. 4, 2013

(54) SUSPENSION DEVICE

(75) Inventors: Takashi Kunishita, Tokyo (JP); Ryo Sugimoto, Tokyo (JP)

(73) Assignee: Uhchida Yoko Co., Ltd., Tokyo (JP)

( * ) Notice: Subject to any disclaimer, the term of this patent is extended or adjusted under 35 U.S.C. 154(b) by 27 days.

(21) Appl. No.: 12/680,431

(22) PCT Filed: Jul. 16, 2008

(86) PCT No.: PCT/JP2008/062817

§ 371 (c)(1),
(2), (4) Date: Jun. 22, 2010

(87) PCT Pub. No.: WO2009/041150

PCT Pub. Date: Apr. 2, 2009

(65) Prior Publication Data

US 2010/0252704 A1 Oct. 7, 2010

(30) Foreign Application Priority Data

Sep. 28, 2007 (JP) ..... 2007-254910

(51) Int. Cl.
*E04B 2/00* (2006.01)
*E04B 5/00* (2006.01)
*A47H 1/00* (2006.01)

(52) U.S. Cl.
USPC ..... 248/317; 248/343; 52/506.06; 52/506.08

(58) Field of Classification Search
USPC ..... 248/317, 322, 343, 223.41, 223.51, 248/224.61, 207; 52/506.7, 506.8, 656.8, 52/506.05, 506.06, 506.07, 506.08, 506.09, 52/842
See application file for complete search history.

(56) References Cited

U.S. PATENT DOCUMENTS

| | | | | | |
|---|---|---|---|---|---|
| 3,004,636 | A | * | 10/1961 | Morris | 52/239 |
| 3,035,672 | A | * | 5/1962 | Tuten et al. | 52/656.8 |
| 3,708,941 | A | * | 1/1973 | Cuckson | 52/506.08 |
| 3,832,816 | A | * | 9/1974 | Jahn | 52/506.08 |
| 3,998,020 | A | * | 12/1976 | Kuhr et al. | 52/506.07 |
| 4,189,893 | A | * | 2/1980 | Kuhr | 52/506.07 |
| 4,489,529 | A | * | 12/1984 | Ollinger et al. | 52/506.07 |
| 5,896,724 | A | * | 4/1999 | Tofts | 52/842 |
| 7,832,168 | B2 | * | 11/2010 | Lehane et al. | 52/506.07 |
| 2008/0155915 | A1 | * | 7/2008 | Howe et al. | 52/506.06 |

FOREIGN PATENT DOCUMENTS

| | | |
|---|---|---|
| JP | 52-137515 | 10/1977 |
| JP | 6010429 | 2/1994 |
| JP | 6020652 | 3/1994 |

(Continued)

OTHER PUBLICATIONS

International Preliminary Report on Patentability and favorable Written Opinion for PCT/JP2008/062817 issued on May 4, 2010.

*Primary Examiner* — Tan Le
(74) *Attorney, Agent, or Firm* — Alston & Bird LLP

(57) ABSTRACT

A suspension device that suspends, from a ceiling slab, a beam member including a groove portion which extends along an axial center direction thereof and includes an opening portion narrower than an inner space of the groove portion in a cross-section orthogonal to the axial center direction, the suspension device including: a first suspension member including: a first shaft portion; a first connection portion; and a first supporting portion which supports the beam member; and a second suspension member attachable to and detachable from the first suspension member, the second suspension member including: a second shaft portion which supports the beam member.

4 Claims, 13 Drawing Sheets

FOREIGN PATENT DOCUMENTS

| | | |
|---|---|---|
| JP | 07-062784 | 3/1995 |
| JP | 08-074374 | 3/1996 |
| JP | 08-284302 | 10/1996 |
| JP | 11-006238 | 1/1999 |
| JP | 11-071849 | 3/1999 |
| JP | 3004982 | 1/2000 |
| JP | 2000-355999 | 12/2000 |
| JP | 2007-146584 | 6/2007 |

* cited by examiner

SUSPENSION DEVICE

FIELD

The present invention relates to a suspension device.

BACKGROUND

There has been known a technology of a so-called system ceiling for suspending a suspended ceiling including beams and ceiling panels through suspension bolts from a ceiling slab. For example, Patent document 1 discloses, as a technology relating to the system ceiling, a suspension metal connecting a suspension bolt to a suspended ceiling, the suspension metal being fixed to a ceiling slab. The suspension metal described in Patent document 1 supports a beam by sandwiching and holding the beam from the outside.

Further, Patent document 2 discloses, as a technology relating to the system ceiling, a ceiling structure including: suspension members suspended from a ceiling slab; rails fixed to the suspending members; and a panel frame hooked to the rails so that the ceiling panel is hooked and traversed between the rails. The suspension members described in Patent document 2 support the rails by inserting a base end side of each of the suspension members into an inside of each of the rails having a C-channel shape opened upward, to thereby engage the rail with the suspension member in the inside of the each of the rails.

[Patent document 1] Japanese Patent Application Laid-open No. 2007-146584

[Patent document 2] Japanese Patent Application Laid-open No. Hei 11-71849

[Patent document 3] Japanese Patent Application Laid-open No. Hei 07-62784

[Patent document 4] Japanese Patent Application Laid-open No. Hei 08-284302

[Patent document 5] Japanese Patent Application Laid-open No. 2000-355999

[Patent document 6] Japanese Patent No. 3004982

[Patent document 7] Japanese Utility Model Application Laid-open No. Hei 06-10429

[Patent document 8] Japanese Utility Model Application Laid-open No. Hei 06-20652

[Patent document 9] Japanese Patent Application Laid-open No. Hei 08-74374

SUMMARY

There has been known, as a technology of connecting a suspended ceiling to a ceiling slab, a technology of supporting a beam having a structure in which, for example, the suspension metal is constructed by two members, and the beam is sandwiched and held by the two members from the outside of the beam. According to the technology, it is possible to relatively easily support the beam. However, the suspension metal is arranged outside the beam. Accordingly, in a case where the suspension metal is used thereon, the suspended ceiling must be designed under the considerations of the thickness of the suspension metal and the like in addition to the width dimension of the beam. Thus, there arises a problem such as complicated designing. Further, as the thickness of the suspension metal must be taken into consideration for the designing, there also arises a problem in that its installation space cannot be sufficiently efficiently utilized. In addition, a connection portion between the beam and the suspension metal is exposed to the outside thereof, and hence there is also such a fear in that the suspended ceiling does not look fine on the outside.

Meanwhile, there has been known a technology of supporting rails having a structure in which a base end side of each of suspension members is inserted into the inside of each of the rails having a C-channel shape opened upward and the rail is engaged with the suspension member in an inside of the rail. According to the technology, in a case of designing the suspended ceiling, there is no need to take the thickness, etc. of the suspension member into consideration, thereby being capable of facilitating the designing. Further, the suspension members are free from being exposed to the outside of the rails, and hence its installation space may be efficiently utilized. In addition, the suspension members are free from projecting to the outside of the rails, thereby being capable of enhancing the look of the appearance. Here, as in the technology of supporting the rails from the inside of the rails by inserting the each of the suspension members into the inside of the each of the rails as described above, if taking such a structure that the beam is supported by inserting a part of suspension device (suspension member) into the inside of the beam, there are required easy insertion and ensured sufficient supporting force. For example, in the technology, a larger opening portion is formed for the base end side of the suspension member to be inserted therein, to thereby ensure the easy insertion. However, a contact area between the suspension member and the rail is correspondingly smaller, and hence there is a fear in that sufficient supporting force can not be ensured.

The present invention has been made in view of the above-mentioned problems, and it is an object of the present invention to provide a suspension device which supports a beam member from an inside of the beam member, and which is excellent in workability and capable of ensuring sufficient supporting force.

In the present invention, in order to solve the above-mentioned problems, the following means are adopted. That is, the present invention provides a suspension device that suspends, from a ceiling slab, a beam member including a groove portion which extends along an axial center direction thereof and includes an opening portion narrower than an inner space of the groove portion in a cross-section orthogonal to the axial center direction, the suspension device including: a first suspension member including: a first shaft portion; a first connection portion which is provided on a base end side of the first shaft portion, and is connected to the ceiling slab; and a first supporting portion which is provided on a tip end side of the first shaft portion, is inserted into the groove portion through the opening portion, and comes into contact with an inside on one side of the groove portion when the opening portion is assumed as a base line, to thereby support the beam member; and a second suspension member attachable to and detachable from the first suspension member, the second suspension member including: a second shaft portion held in contact with the shaft portion of the first suspension member; a second supporting portion which is provided on a tip end side of the second shaft portion, is inserted into the groove portion through the opening portion, and comes into contact with the inside on another side of the groove portion when the opening portion is assumed as the base line, to thereby support the beam member.

The present invention includes: the first suspension member including the first supporting portion that supports the inside on the one side of the beam member; and the second suspension member being attachable to and detachable from the first suspension member, and including the second supporting portion that supports the inside on the another side of the beam member. The suspension device according to the present invention is constructed by the separable two members (first suspension member and second suspension member). Thus, the suspension members may be separately inserted into the groove portion of the beam member. Consequently, the suspension members may easily be inserted through a narrow opening portion, which makes insertion difficult if the first suspension member and the second suspension member are integrally formed with each other. Further, the opening portion of the groove portion is made narrower than the conventional opening portion, and hence it is possible to increase the contact area between each of the suspension members and the groove portion of the beam member upon insertion of the suspension members. Thus, it is possible to ensure sufficient supporting force. In addition, according to the present invention, the suspension device is free from being exposed to the outside of the beam member, and hence installation space may be efficiently utilized. Further, the suspension device is not exposed to the outside of the beam member, thereby being capable of enhancing the look of the appearance.

The suspension device according to the present invention is one in which the first supporting portion and the second supporting portion are inserted into the groove portion provided to the suspension member, to thereby support the suspension member from the inside. Therefore, the beam member is needed to include a predetermined groove portion. The predetermined groove portion may be a groove portion extending along an axial center direction and including an opening portion narrower than the inner space of the groove portion in a cross-section orthogonal to the axial center direction. Note that, a plurality of groove portions as described above may be provided in the beam member. In this case, it is preferred that the cross-section of the beam member be evenly divided into a plurality of parts, and the plurality of groove portions be provided for the divided parts, respectively, along a longitudinal direction of the beam member. With this, the suspension members may be connected irrespective of the orientation of the beam member, and hence it is possible to enhance the convenience. Note that, the groove portion may be utilized not only as a connection portion to the suspension device but also as an insertion portion of the ceiling panel, or a connection portion such as a metal for hooking lighting equipment. Therefore, also in this aspect, it is preferred to provide a plurality of groove portions.

The opening portion of the groove portion extends in a direction in which the groove portion extends, in other words, in the longitudinal direction of the beam member. Note that, it is unnecessary for the opening portion to extend over the entire length of the beam member, and a plurality of opening portions may partially extend in the longitudinal direction. "The groove portion including the opening portion narrower than an inner space of the groove portion in the cross-section orthogonal to the axial center direction" means that an inlet (opening portion) is narrow, and an inner space is larger than the inlet. With this structure, when the supporting portion is inserted into the opening portion, the inserted supporting portion is caught in the vicinity of the opening portion, thereby being supported by the supporting portion.

The first suspension member includes a shaft portion, a first connection portion, and a first supporting portion. The first connection portion is connected to the ceiling slab provided on a base end side of the shaft portion. The first supporting portion is provided on a tip end side of the shaft portion, and supports the beam member from the inside of the groove portion of the beam member. The first connection portion may be directly connected to the ceiling slab, and preferably, is connected through mounting portions such as the suspension bolts or the hooks provided in advance to the ceiling slab.

The first supporting portion is inserted into the groove portion through the opening portion, and comes into contact with the inside on the one side of the groove portion when the opening portion is assumed as the base line, to thereby support the beam member. For example, the first supporting portion may be formed by being bent to a predetermined angle with respect to the shaft portion. The first supporting portion may be more smoothly inserted into the groove portion by controlling a direction of the first supporting portion. Meanwhile, when the first supporting portion is pulled up in the vertical direction while the first supporting portion is inserted therein, the first supporting portion is caught in the vicinity of the opening portion, and hence the support by the first supporting portion in the groove portion may be achieved. In this case, the opening portion of the groove portion into which the first supporting portion is inserted is one which extends along the axial center direction, and the groove portion may be classified as the one side and the another side as the opening portion being a base line, in other words, as the one side and the another side while sandwiching the opening portion therebetween. The first supporting portion is brought into contact with the inside on one of the one side and the another sides of the groove portion, to thereby support the beam member.

The second suspension member includes: a second shaft portion held in contact with the shaft portion of the first suspension member; and a second supporting portion which is provided on a tip end side of the second shaft portion, and comes into contact with the inside on the another side of the groove portion, to thereby support the beam member. For example, the first suspension member and the second suspension member may be arranged so that the first shaft portion and the second shaft portion are held in contact with each other along the axial direction and are fixed to each other with the fixation members or the like. By performing or releasing the fixation with the fixation members, the first suspension member and the second suspension member may be attached to and detached from each other. The second supporting portion may be, similarly to the first supporting portion, formed by being bent to a predetermined angle with respect to the shaft portion. Note that, the second supporting portion is needed to be brought into contact with the inside on the another side of the groove portion differently from the first supporting portion. Therefore, it is preferred that the direction of bending the first supporting portion be a direction opposite to the direction of bending the first supporting portion when the second suspension member is fixed to the first suspension member. With this structure, insertion into the groove portion is allowed. Further, when the second supporting portion is pulled up in the vertical direction while the second supporting portion is inserted therein, the second supporting portion is caught in the vicinity of the opening portion, and hence the support by the second supporting portion in the groove portion may be achieved.

Here, in the present invention, the second suspension member may further include, on a base end side of the second shaft portion, a second connection portion connected to the ceiling slab together with the first connection portion of the first suspension member.

The second connection portion is connected to the ceiling slab together with the first connection portion of the first suspension member. In other words, the second connection portion is connected to the ceiling slab in the substantially same position as the first connection portion of the first suspension member. Therefore, according to the present invention, a load against the first supporting portion is transmitted to a ceiling bolt through the first shaft portion and the first connection portion. A load against the second supporting portion is transmitted to the ceiling bolt through the second shaft portion and the second connection portion. That is, it is possible to disperse the load generated in the suspension device into the first supporting member and the second supporting member, and hence the more stable support may be achieved.

Further, in the present invention, the ceiling slab may be provided in advance with a suspension bolt that suspends the beam member, and the first connection portion may include an insertion hole into which the suspension bolt is inserted, thereby being connected to the suspension bolt provided to the ceiling slab. The suspension device may further include a fixation member that fixes the suspension bolt and the first connection portion into which the suspension bolt is inserted.

As the fixation member for fixing the first connection portion, into which the suspension bolt is inserted, there are exemplified nuts to screw onto the suspension bolt. The insertion hole into which the suspension bolt is inserted may include a typical hole portion. In this case, the suspension bolt may be inserted into the insertion hole from below the suspension bolt, and the fixation with the fixation member is performed. Note that, the shape of the insertion hole is not particularly limited, and for example, a U-shaped insertion hole may be used by partially opening the insertion hole. In this way, connection to the suspension bolt in the horizontal direction is allowed, and hence workability may be further enhanced.

Note that, if the second suspension member is provided with the second connection portion, the second connection member is also preferably provided with the insertion hole into which the suspension bolt is inserted. Further, when the insertion hole provided in the second connection member is also shaped into a U-shape, the workability may be enhanced.

According to the above-mentioned invention, the suspension device is constructed by the two separable members, and hence the supporting portion of each of the suspension members may be inserted into the groove portion from above the groove portion. Therefore, for example, even if, thereafter, the number of the suspension devices is needed to be increased under consideration of the loads against the beam member, it is possible to add the suspension devices without detaching the beam member. Note that, if the groove portion of the beam member is provided to extend up to the end portion thereof, the suspension device may be inserted through the end portion of the beam member. In such case, the suspension device may be inserted into the beam member under a state in which the first suspension member and the second suspension member are connected to each other, and the first suspension member and the second suspension member may not be attached to and detached from each other. That is, the first suspension member and the second suspension member may be integrally formed with each other.

Further, the present invention may provide a suspension device including functions of the first suspension member and the second suspension member according to the present invention described above, in which the first suspension member and the second suspension member are integrally formed with each other. With such integral suspension device, it is possible to reduce the number of members in comparison with the separable suspension device as described above. Further, when both of the integral suspension device and the separable suspension device are prepared and used depending on purposes, the workability may be further enhanced upon using the suspension device according to the present invention so as to construct the system ceiling, for example.

According to the present invention, it is possible to provide the suspension device which supports the beam member from the inside of the beam member, and which is excellent in the workability and capable of ensuring the sufficient supporting force.

DESCRIPTION OF EMBODIMENTS

Next, an embodiment of a suspension device according to the present invention is described with reference to the drawings.

(Structure)

Figure 1:
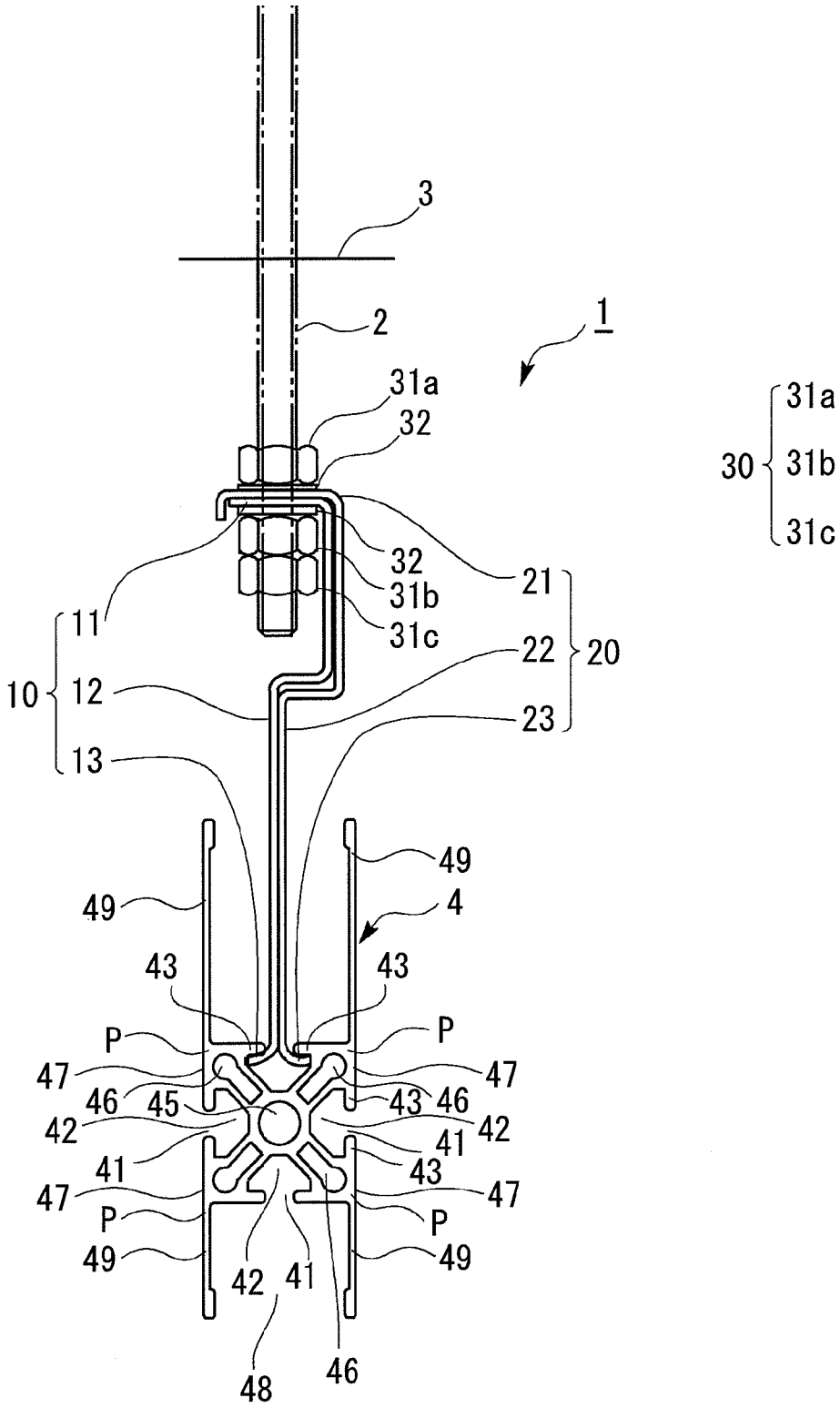
FIG. 1 is a front view of a suspension device according to an embodiment.
Figure 2:
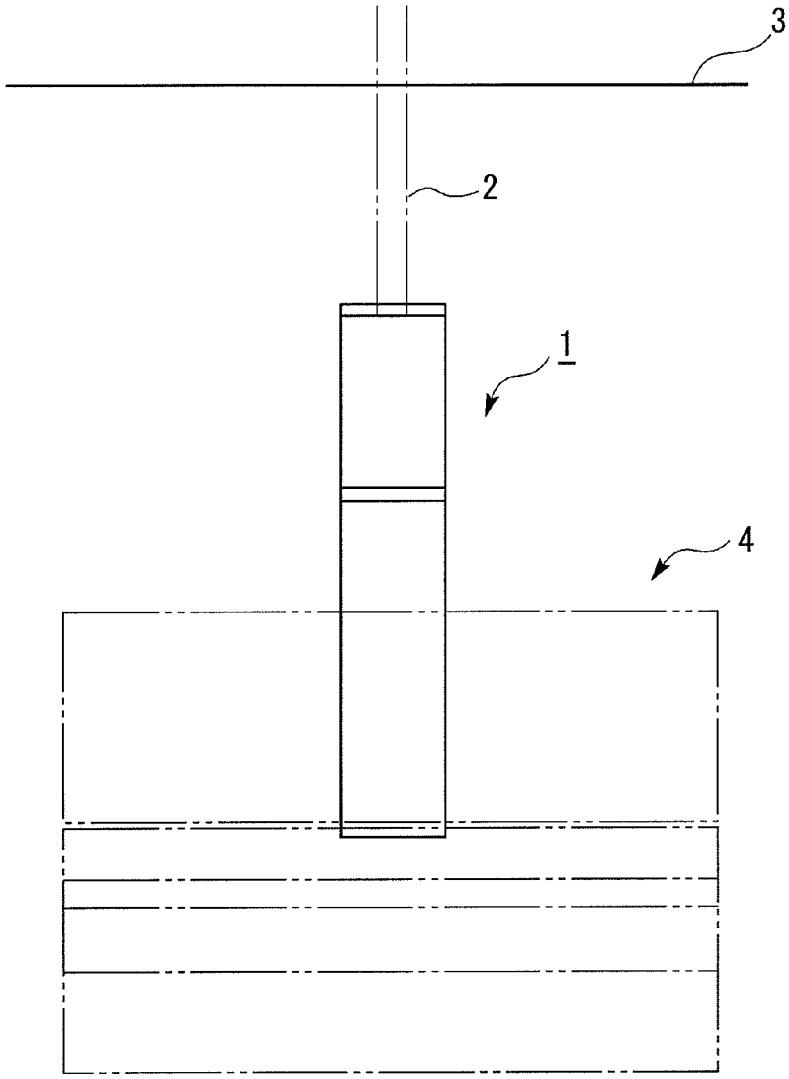
FIG. 2 is a side view of the suspension device according to the embodiment.
Figure 3:
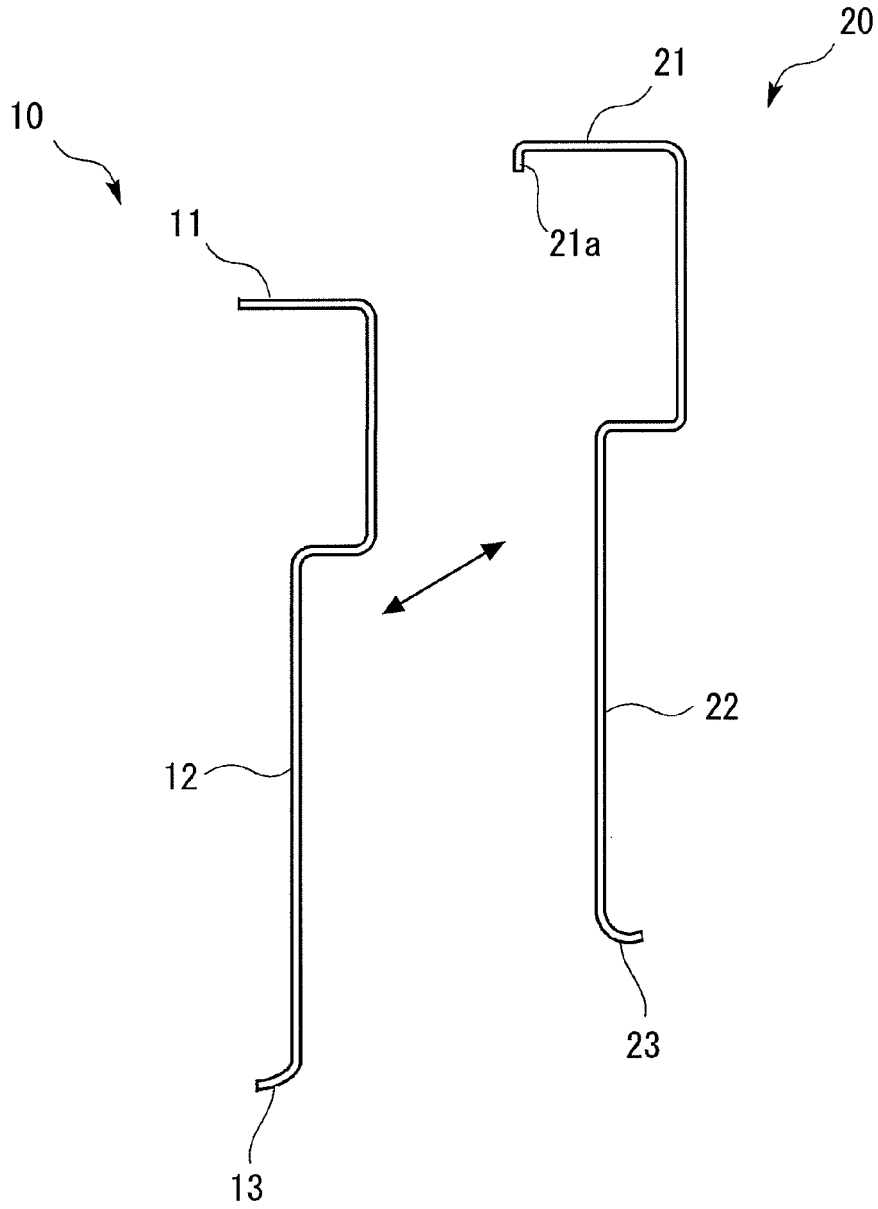
FIG. 3 is a view illustrating a separated state of the suspension device according to the embodiment.

FIG. 1 illustrates a front view of a suspension device according to an embodiment. FIG. 2 illustrates a side view of the suspension device according to the embodiment. FIG. 3 illustrates a separated state of the suspension device according to the embodiment. Note that, both of FIG. 1 and FIG. 2 illustrate a state in which a suspension device 1 is connected to a suspension bolt 2, and in which a suspension device 1 suspends a beam 4. The suspension device 1 of the embodiment includes a first suspension member 10, a second suspension member 20, and nuts 30 serving as fixation members. Hereinafter, each structure thereof is described further in detail.

First, descriptions are made of the suspension bolt 2 connecting the suspension device 1 of the embodiment thereto, and the beam 4 supported by the suspension device 1 of the embodiment. The suspension bolt 2 is fixed in advance to a ceiling slab 3, and supports, through the suspension device 1 connected thereto, the beam 4. In other words, the ceiling slab 3 is a ceiling slab of an upper floor. The suspension bolt 2 is embedded in such ceiling slab 3 to be fixed thereto.

The beam 4 has a shape in cross-section, which is evenly divided into four parts. Dividing walls 46 extend radially from a center portion 45 to four directions, tip ends of the dividing walls 46 form vertexes P of a square in the cross-section of the beam 4. A wall surface 47 extends from one vertex P toward an adjacent vertex P. The wall surface 47 extending from one vertex P and the wall surface 47 extending from another adjacent vertex P do not link to each other in such a manner that the both of wall surfaces 47 end before the center of both of the vertexes P. Therefore, between the wall surfaces 47 and 47 opposed to each other, there is formed an opening portion 41. Further, a pair of the wall surfaces 47, a pair of dividing walls 46, and the center portion 45 form a groove portion 42. The opening portion 41 and the groove portion 42 extend in an axial center direction of the beam 4 over the entire length thereof. Further, the opening portion 41 is formed to be narrower than an inner space of the groove portion 42. A tip end portion of the wall surface 47 forms a lid portion 43. The lid portion 43 prevents a first supporting portion 13 and a second supporting portion 23 inserted into the groove portion 42, which are described later, from being detached off therefrom. Further, the lid portion 43 functions as a contact portion when the lid portion 43 is supported by the first supporting portion 13 and the like.

Note that, the beam 4 of the embodiment is further provided with two outer wall surfaces 49. The two outer wall surfaces 49 extend in each of the vertexes P in the cross-section of the beam 4 from each of the vertexes P to the outside of the beam 4, and are orthogonal to two wall surface 47 connecting to the vertexes P, respectively. Consequently, an outer wall surface 49 extending from one vertex P and an outer wall surface 49 extending from another adjacent vertex P are opposed to each other. Further, the outer wall surfaces 49 opposed to each other and a pair of wall surfaces 47 connecting the outer wall surfaces 49 form a wiring groove portion 48 on a surface of the beam 4, wiring groove portion 48 being a semi-closed space. The wiring groove portion 48 houses therein a cable for lighting equipment, a cable for information equipment, or the like. Note that, the wiring groove portion may be provided with a cover, to thereby improve the design.

Figure 4:
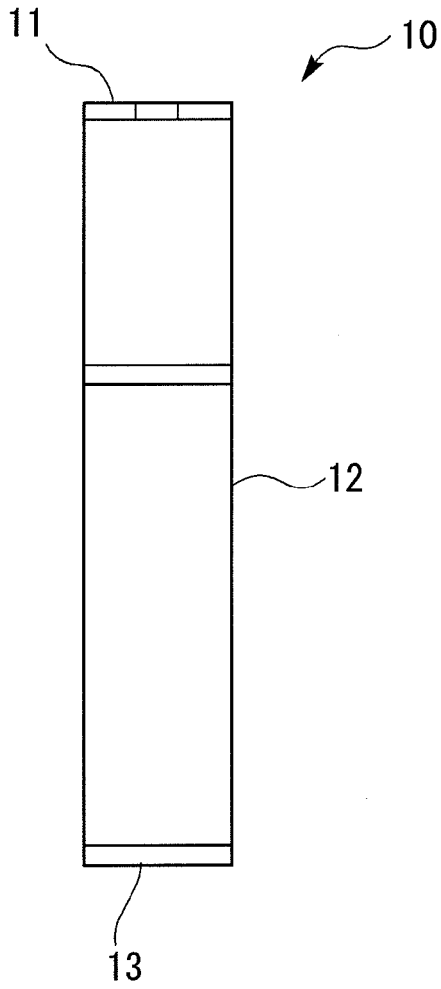
FIG. 4 is a side view of a first suspension member.
Figure 5:
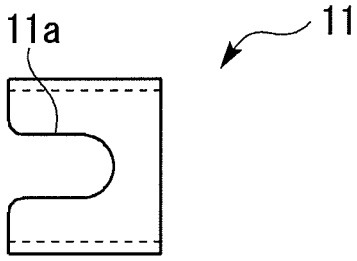
FIG. 5 is a view illustrating a first connection portion of the first suspension member.

Next, the first suspension member 10 is described with reference to FIG. 1 to FIG. 3 as well as FIG. 4 and FIG. 5. Note that, FIG. 4 is a side view of the first suspension member 10, and FIG. 5 illustrates a plan view of a first connection portion 11 of the first suspension member 10. The first suspension member 10 includes a first shaft portion 12, the first connection portion 11, and the first supporting portion 13. The first connection portion 11 is provided on a base end side (ceiling slab 3 side) of the first shaft portion 12, and is connected to the suspension bolt 2. The first supporting portion 13 is provided on a tip end side (beam 4 side) of the first shaft portion 12, and inserted into the groove portion 42 of the beam 4, to thereby support the beam 4.

The first shaft portion 12 is formed of a slim flat plate member. The first shaft portion 12 is substantially vertically arranged in a state in which first shaft portion 12 is connected to the suspension bolt 2. Therefore, in other words, the first shaft portion 12 is a vertical portion. The first shaft portion 12 is basically liner. The axial center of the first shaft portion 12 in a liner part (from lower part up to middle part) is substantially aligned with the axial center of the suspension bolt 2. In this way, the beam 4 may be stably supported. Note that, an upper part of the first shaft portion 12 is outwardly bent without contact with the nuts 30. Further, in a further upper part of the outwardly bent part, that is, on the base end side of the first shaft portion 12, the first connection portion 11 horizontally formed so as to be orthogonal to the suspension bolt 2 is provided.

The first connection portion 11 is formed by bending a part on the base end side of the substantially vertical first shaft portion 12 to a substantially right angle. Further, the first connection portion 11 is provided with an insertion hole 11*a* for inserting therein the suspension bolt 2. The insertion hole 11*a* of the embodiment has, as illustrated in FIG. 5, a partially opened U-shape. With this structure, the connection to the suspension bolt 2 in the horizontal direction is allowed. Note that, the mode of the insertion hole 11*a* is not limited thereto. The insertion hole 11*a* may be a typical hole portion, in this case, the suspension bolt 2 may be inserted into the insertion hole 11*a* from below the suspension bolt 2.

On the base end side of the first shaft portion 12, the first supporting portion 13 is provided. The first supporting portion 13 being horizontally formed by bending a part on the base end side of the first shaft portion 12 to a substantially right angle. The first supporting portion 13 is inserted into the groove portion 42 of the beam 4 through the opening portion 41, and comes into contact with the lid portion 43 on one side (left side on the sheet in FIG. 1), to thereby support the beam 4.

Figure 6:
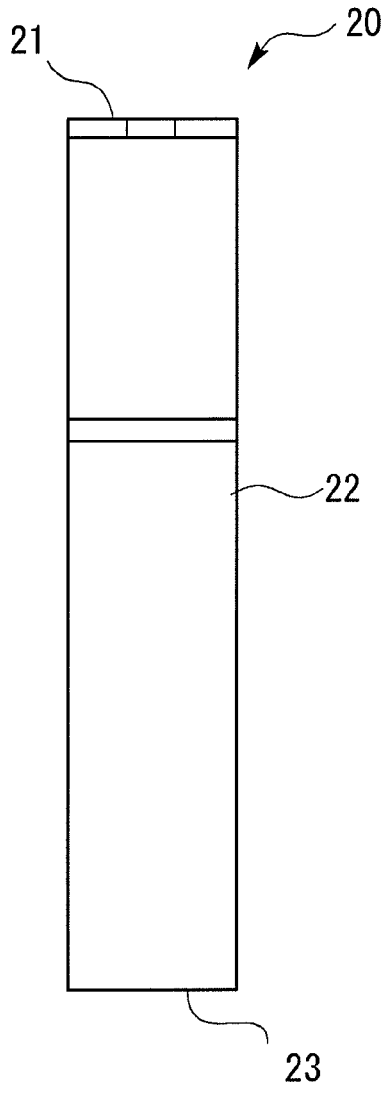
FIG. 6 is a side view of a second suspension member.
Figure 7:
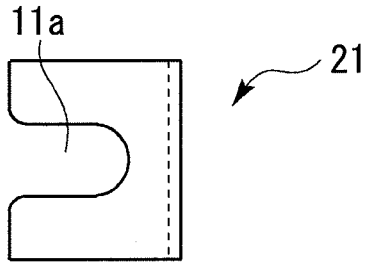
FIG. 7 is a plan view of a second connection portion of the second suspension member.

Next, the second suspension member 20 is described with reference to FIG. 1 to FIG. 3 as well as FIG. 6 and FIG. 7. Here, FIG. 6 is a side view of the second suspension member, and FIG. 7 illustrates a plan view of a second connection portion 21 of the second suspension member 20. The second suspension member 20 includes a second shaft portion 22, the second connection portion 21, and the first supporting portion 13. The second connection portion 21 is provided on a base end side (ceiling slab 3 side) of the second shaft portion 22, and is connected to the suspension bolt 2. The first supporting portion 13 is provided on a tip end side (beam 4 side) of the second shaft portion 22, and inserted into the groove portion 42 of the beam 4, to thereby support the beam 4.

The second suspension member 20 has a shape similar to the first suspension member 10 so as to be attached to and detached from the first suspension member 10. That is, the second shaft portion 22 is formed of a slim flat plate member similarly to the first shaft portion 12, and the width dimension of the flat plate member is designed in the same manner. The second shaft portion 22 is also basically linear. Further, in the linear part (from lower part up to middle part), the axial center of the second shaft portion 22 is substantially aligned with the axial center of the suspension bolt 2. In this way, the beam 4 may be stably supported. An upper part of the second shaft portion 22 is formed by outwardly bending correspondingly to the upper part of the first shaft portion 12 outwardly bent without contact with the nuts 30. Note that, the second suspension member 20 is connected to the outside of the first suspension member 10, and hence, in the suspension device 1 of the embodiment, the bent portion of the upper part of the second shaft portion 22 is formed to be larger than the bent portion of the first shaft portion 12. Further, for the purpose that the second connection portion 21 provided in the upper part of the second shaft portion 22 may be arranged on an upper side of the first connection portion 11 of the first suspension member 10, the length dimension of the second shaft portion is designed to be slightly larger than the length dimension of the first shaft portion 12.

The second connection portion 21 is, similarly to the first connection portion 11, formed by bending a part on the base end side of the vertical second shaft portion 22 to a substantially right angle. Further, the second connection portion 21 is provided with the insertion hole 11*a* for inserting the suspension bolt 2 therein, and the insertion hole 11*a* is formed into a partially opened U-shape as illustrated in FIG. 7. Therefore, the second suspension member 20 may be also connected to the suspension bolt 2 in the horizontal direction. Meanwhile, an end portion of the second connection portion 21 is provided with a folded-back portion 21*a* unlike the first connection portion 11. The folded-back portion 21*a* is formed by downwardly bending the end portion of the second connection portion 21 in the vertical direction so as to be substantially in parallel to the second shaft portion 22. The folded-back portion 21*a* regulates movement in the horizontal direction of the second suspension member 20, and regulates movement in the horizontal direction of the first suspension member 10 together with the second suspension member 20. Therefore, according to the suspension device 1 of the embodiment, the second suspension member 20 includes the folded-back portion 21*a*, and hence it is possible to effectively prevent the first suspension member 10 and the second suspension member 20 from being detached off from the suspension bolt 2.

On the base end side of the second shaft portion 22, similarly to the first suspension member 10, there is a second supporting portion 23. The second supporting portion 23 is horizontally formed by bending a part on the base end side of the second shaft portion 22 to a substantially right angle. Note that the second supporting portion 23 is bent to a direction opposite to the first supporting portion 13. With this, the second supporting portion 23 is inserted into the groove portion 42 of the beam 4 through the opening portion 41, and comes into contact with the lid portion 43 on another side (right side on the sheet in FIG. 1), to thereby support the beam 4.

Next, the nuts 30 are described. The nuts 30 correspond to the fixation members in the present invention, and sandwich and fix the first suspension member 10 and the second suspension member 20, which are connected to the suspension bolt 2. In the embodiment, onto an upper side of the first connection portion 11 and the second connection portion 21, one nut 30*a* is fixed, and onto a lower side of the first connection portion 11 and the second connection portion 21, two nuts 30*b* and 30*c* are fixed under consideration of load to the gravitational direction. Further, between the nuts 30 and each of the connection portions, there is arranged a washer 32.

(Use Method)

Next, a use method of the suspension device 1 is described. The suspension device 1 may be separated into the first suspension member 10 and the second suspension member 20 (see FIG. 2). Thus, a method of fixing the beam 4 and the suspension bolt 2 of the suspension device 1, in which this characteristic is utilized, is described. First, the supporting portion of one of the first suspension member 10 and the second suspension member 20 is inserted into the groove portion 42. Upon insertion, by tilting the supporting portion, it is possible to more smoothly insert the supporting portion. After insertion of the one suspension member, then, the supporting portion of the other suspension member is inserted into the groove portion 42. Upon insertion, also in this case, by tilting the supporting portion, it is possible to more smoothly insert the supporting portion.

After insertion of the supporting portions of both of the suspension members, the first shaft portion 12 and the second shaft portion 22 are connected to the predetermined suspension bolt 2 while performing adjustment so that the first shaft portion 12 and the second shaft portion 22 are superposed on each other. That is, by causing the first shaft portion 12 and the second shaft portion 22 to be superposed on each other, the positions of the insertion holes of the suspension members are aligned with each other, and then, the suspension bolt 2 is inserted into the aligned insertion holes, to thereby fix the suspension bolt 2 with the nuts 30. Note that, regarding the nuts 30, for example, the positions of the two lower nuts 30 may be defined in advance so as to take a height, and, after connection of the suspension members, the upper nut 30 arranged in advance at an interval with respect to the two lower nuts 30 may be gradually lowered. In this manner, the suspension members may be finally sandwiched and fixed by the nuts 30.

As described above, according to the suspension device 1, it is possible to fix each of the supporting portions of the suspension device 1 into the groove portion 42 of the beam 4 from above the beam 4. Therefore, for example, even if the number of the suspension devices 1 is thereafter needed to be increased under consideration of the loads against the beam 4, it is possible to add the suspension devices 1 without detaching the beam 4. Note that the method is merely an example. If the groove portion 42 of the beam 4 is provided to extend up to the end portion thereof, the suspension device 1 may be inserted through the end portion of the beam 4.

Application Example

Figure 8:
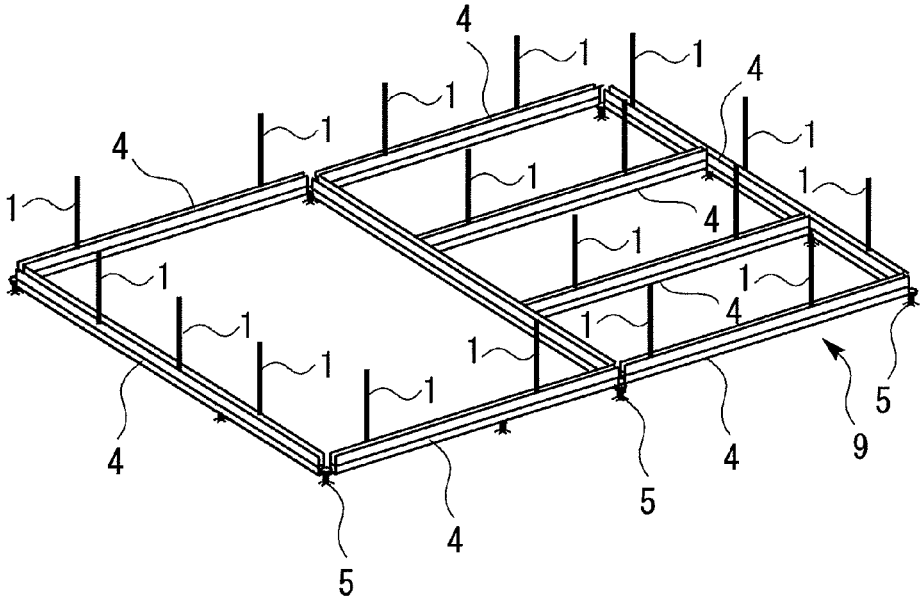
FIG. 8 is a view illustrating an example of a system ceiling including suspension devices and beams.

Here, FIG. 8 illustrates an example of a system ceiling 9 including the suspension devices 1 and the beams 4. As illustrated in FIG. 8, the system ceiling 9 is constructed through connecting a plurality of beams 4 to each other through connection devices 5. Further, each of the beams 4 is supported by the suspension device 1 with respect to the ceiling slab (not shown). Note that, though, in a constitution example illustrated in FIG. 8, only the beams 4 constitutes the suspended ceiling, the ceiling panel may be provided between the beams 4. Further, by applying the system ceiling 9, it is also possible that column members (poles) are connected to the lower side of the connection devices 5, and further, a wall member is arranged between the column members, to thereby constitute one space structure.

(Effects)

According to the above-mentioned suspension device 1 of the embodiment, the separable two members (first suspension member 10 and second suspension member 20) constitutes the suspension device 1. Thus, the suspension members may be separately inserted into the groove portion 42 of the beam 4. Consequently, the suspension members may easily be inserted through the narrow opening portion, which makes the insertion difficult if the first suspension member 10 and the second suspension member 20 are integrally formed with each other. Further, the opening portion of the groove portion 42 may be set to be narrower than the conventional opening portion, and hence it is possible to increase the contact area between each of the suspension members and the inside of the groove portion 42 of the beam 4 upon the insertion of the suspension members. Thus, it is possible to ensure the sufficient supporting force. In addition, according to the suspension device 1, the suspension device 1 is not projected to the outside of the beam 4, and hence the installation space may be efficiently utilized. Further, the suspension device 1 is not exposed to the outside of the beam 4, thereby being capable of enhancing the look of the appearance.

Modification Example

Figure 9:
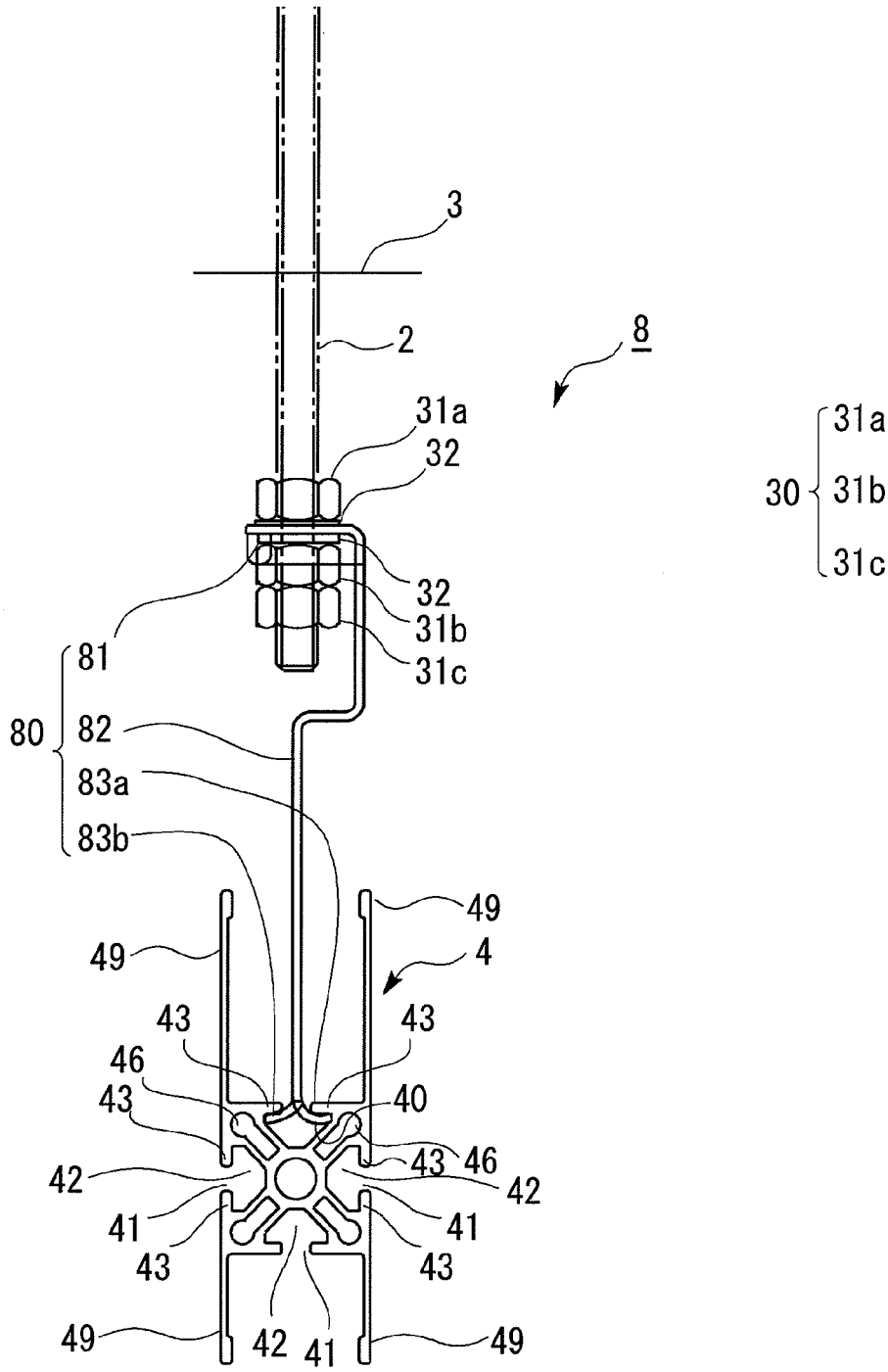
FIG. 9 is a view illustrating a use state of a suspension device according to a modification example.
Figure 10:
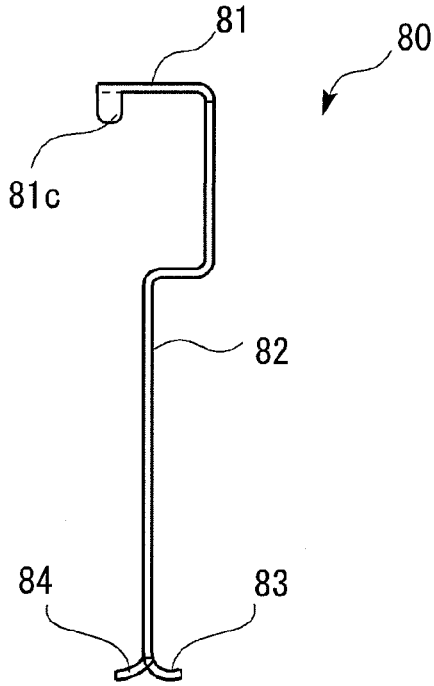
FIG. 10 is a front view of the suspension device according to the modification example.
Figure 11:
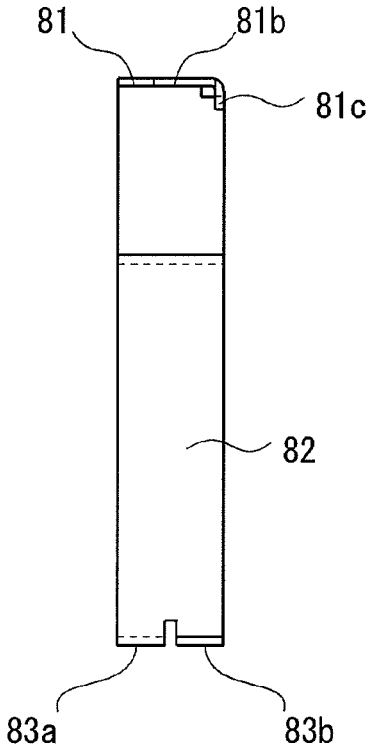
FIG. 11 is a side view of the suspension device according to the modification example.
Figure 12:
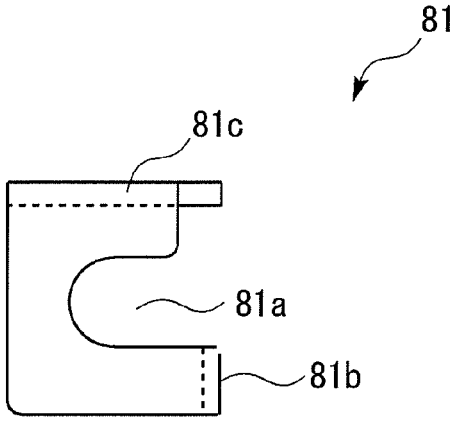
FIG. 12 is a plan view of a connection portion of the suspension device according to the modification example.
Figure 13:
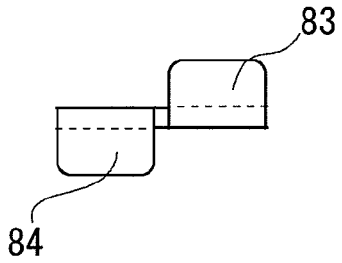
FIG. 13 is a plan view of a supporting portion of the suspension device according to the modification example.

Next, a modification example of a suspension device according to the present invention is described. According to the above-mentioned suspension device 1, by constructing the suspension device by the separable two suspension members, it is possible to insert each of the supporting portions from above the groove portion 42 into the groove portion 42. Meanwhile, if the groove portion 42 of the beam 4 is provided to extend up to the end portion thereof, the suspension device 1 may be inserted through the end portion of the beam member. In such case, it is sufficient to insert the suspension device 1 through the end portion of the beam 4 into the groove portion 42 of the beam 4 under the state in which the first suspension member 10 and the second suspension member 20 are connected to each other, and the first suspension member 10 and the second suspension member 20 may not be attached and detached with respect to each other. Specifically, the first suspension member 10 and the second suspension member 20 may be integrally formed with each other, and a suspension device 8 according to a modification example is constructed only by one suspension member. FIG. 9 is a view illustrating a use state of the suspension device 8 according to the modification example. FIG. 10 is front view of the suspension device 8 according to the modification example, and FIG. 11 illustrates a side view of the suspension device 8 according to the modification example. Further, FIG. 12 illustrates a plan view of a connection portion of the suspension device 8 according to the modification example, and FIG. 13 illustrates a plan view of a supporting portion of the suspension device 8 according to the modification example.

In the suspension device 8 according to the modification example, the first suspension member 10 and the second suspension member 20 in the suspension device 1 are integrally formed with each other. That is, the suspension device 8 according to the modification example is constructed by one suspension member 80 and nuts 30 serving as the fixation members. Note that, the same members are indicated by the same reference symbols, and the description thereof is omitted.

The suspension member 80 according to the modification example includes a third shaft portion 82, a third connection portion 81, and third supporting portions 83*a* and 83*b*. The third connection portion 81 is provided on a base end side of the third shaft portion 82 (ceiling slab 3 side), and is connected to the suspension bolt 2. The third supporting portions 83*a* and 83*b* are provided on a tip end portion of the third shaft portion 82 (beam 4 side), and is inserted into the groove portion 42 of the beam 4, to thereby support the beam 4.

The third shaft portion 82 is formed of a slim flat plate member similarly to the first suspension member 10 and the second suspension member 20. The third shaft portion 82 is also basically linear. Further, in the linear part (from lower part up to middle part), the axial center of the third shaft portion 82 is substantially aligned with the axial center of the suspension bolt 2. In this way, the beam 4 may be stably supported. An upper part of the third shaft portion 82 is formed by being bent outwardly without the contact with the nuts 30.

The third connection portion 81 is formed by bending a part on the base end side of the vertical third shaft portion 82 to a substantially right angle. Further, the third connection portion 81 is provided with an insertion hole 81*a* for inserting the suspension bolt 2 therein, and the insertion hole 81*a* is formed into a partially opened U-shape as illustrated in FIG. 12. Meanwhile, an end portion of the third connection portion 81 is provided with a folded-back portion 81*b*. The folded-back portion 81*b* is formed by downwardly bending the end portion of the third connection portion 81 in the vertical direction so as to be substantially in parallel to the third shaft portion 82. In addition, an end portion, which is adjacent to the end portion provided with the folded-back portion 81*b*, of the third connection portion 81 is provided with a second folded-back portion 81*c*. The folded-back portions 81*b* and 81*c* regulate the movement of the suspension member 80 in the horizontal direction. Therefore, according to the suspension device 8 of the modification example, the suspension member 80 includes the two folded-back portions 81*b* and 81*c*, and hence it is possible to effectively prevent the suspension member 80 from being detached off from the suspension bolt 2.

On the base end side of the third shaft portion 82, the third supporting portions 83*a* and 83*b* are provided. The third supporting portions 83*a* and 83*b*, similarly to the first suspension member 10 and the like, the third supporting portions 83*a* and 83*b* are provided. The third supporting portions 83*a* and 83*b* are horizontally formed by bending a part on the base end side of the third shaft portion 82 to a substantially right angle. Note that, the third supporting portions 83*a* and 83*b* are constructed by two supporting portions formed by dividing the third shaft portion 82 in the vicinity of the center in a width direction of the beam 4 and by bending the divided third shaft portions 82 to directions opposite to each other, respectively. One third supporting portion 83*a* is inserted into the groove portion 42 of the beam 4 through the opening portion 41, and comes into contact with the lid portion 43 on one side (left side on the sheet in FIG. 9), to thereby support the beam 4. The other third supporting portion 83*b* is inserted into the groove portion 42 of the beam 4 through the opening portion 41, and comes into contact with the lid portion 43 on the other side (right side on the sheet in FIG. 9), to thereby support the beam 4.

Note that, it is sufficient that, when the suspension device 8 according to the modification example is used for suspending the beam 4, the suspension device 8 is inserted in advance through the end portion of the beam 4, and the suspension device 8 is fixed to the predetermined suspension bolt 2.

According to the above-mentioned suspension device 8 of the modification example, it is possible to reduce the number of members in comparison with the separable suspension device 1. Further, according to the suspension device 8, similarly to the suspension device 1, the installation space may be efficiently utilized, and, in addition, the look of the appearance of the suspended ceiling may be enhanced. Note that, if both of the integrated suspension device 8 and the separable suspension device 1 are prepared and used depending on purposes, the workability may be further enhanced upon using the suspension device according to the present invention.

Hereinabove, although the preferred embodiments of the present invention are described, the suspension device of the present invention is not limited thereto, and may includes the combinations thereof as much as possible. Note that, in the above-mentioned embodiments, each member is made of metal, but the material for each member is not particularly limited thereto as long as the each member has a sufficient strength.

What is claimed is:

1. A suspension device that suspends, from a ceiling slab, a beam member comprising a groove portion which extends along an axial center direction thereof and comprises an opening portion narrower than an inner space of the groove portion in a cross-section orthogonal to the axial center direction, the suspension device comprising:

a first suspension member comprising:

a first shaft portion;

a first connection portion which is provided on a base end side of the first shaft portion, and is connected to the ceiling slab, the first connection portion extending generally horizontally and defining an insertion hole extending vertically through the first connection portion; and a first supporting portion which is provided on a tip end side of the first shaft portion, is inserted into the groove portion through the opening portion, and comes into contact with an inside on one side of the groove portion when the opening portion is assumed as a base line, to thereby support the beam member; and a second suspension member formed as a distinct part from the first suspension member and structured and arranged to be separated from the first suspension member, the second suspension member comprising:

a second shaft portion held in contact with the shaft portion of the first suspension member;

a second connection portion provided on a base end side of the second shaft portion and connected to the ceiling slab together with the first connection portion of the first suspension member, the second connection portion extending generally horizontally and defining an insertion hole extending vertically through the second connection portion, wherein the respective insertion holes of the first and second connection portions are configured to be aligned with each other to receive a vertically extending suspension bolt therethrough; and a second supporting portion which is provided on a tip end side of the second shaft portion, is inserted into the groove portion through the opening portion, and comes into contact with the inside on another side of the groove portion when the opening portion is assumed as the base line, to thereby support the beam member, the first and second suspension members when separated from each other allowing separate, sequential insertion of the first and second supporting portions into the groove portion of the beam member.

2. The suspension device according to claim 1, wherein:

the ceiling slab is provided in advance with a suspension bolt that suspends the beam member;

the suspension device further comprises a fixation member that fixes the suspension bolt to the first and second connection portions into which the suspension bolt is inserted.

3. A suspension device that suspends, from a ceiling slab, a beam member comprising a groove portion which extends along an axial center direction thereof and comprises an opening portion narrower than an inner space of the groove portion in a cross-section orthogonal to the axial center direction, the suspension device comprising:

a first suspension member comprising:

a first shaft portion;

a first connection portion which is provided on a base end side of the first shaft portion, and is connected to the ceiling slab, the first connection portion extending generally horizontally and defining an insertion hole extending vertically through the first connection portion; and a first supporting portion which is provided on a tip end side of the first shaft portion, is inserted into the groove portion through the opening portion, and comes into contact with an inside on one side of the groove portion when the opening portion is assumed as a base line, to thereby support the beam member; and a second suspension member formed as a distinct part from the first suspension member and structured and arranged to be separated from the first suspension member, the second suspension member comprising:

a second shaft portion held in contact with the shaft portion of the first suspension member;

a second connection portion provided on a base end side of the second shaft portion and connected to the ceiling slab together with the first connection portion of the first suspension member, the second connection portion extending generally horizontally and defining an insertion hole extending vertically through the second connection portion, wherein the respective insertion holes of the first and second connection portions are configured to be aligned with each other to receive a vertically extending suspension bolt therethrough; and a second supporting portion which is provided on a tip end side of the second shaft portion, is inserted into the groove portion through the opening portion, and comes into contact with the inside on another side of the groove portion when the opening portion is assumed as the base line, to thereby support the beam member, the first and second suspension members when separated from each other allowing separate, sequential insertion of the first and second supporting portions into the groove portion of the beam member;

wherein the ceiling slab is provided in advance with a suspension bolt that suspends the beam member, and the suspension device further comprises a fixation member that fixes the suspension bolt to the first and second connection portions into which the suspension bolt is inserted; and wherein the insertion holes in the first and second connection portions comprise U-shaped open slots that are open at a first edge of each of the first and second connection portions opposite from a second edge to which the respective one of the first and second shaft portions is connected, such that the suspension bolt can be received into the open slots in a horizontal direction and then the fixation member fixed to the suspension bolt can be tightened to fix the suspension device to the suspension bolt.

4. The suspension device according to claim 3, wherein the second connection portion lies above the first connection portion and is in contact therewith, and wherein the second connection portion at the first edge thereof includes a folded-back portion that is bent to extend vertically downward, the folded-back portion regulating movement of the first and second connection portions in the horizontal direction and operating in conjunction with the fixation member to effectively prevent the first and second suspension members from being detached from the suspension bolt.

* * * * *

UNITED STATES PATENT AND TRADEMARK OFFICE

CERTIFICATE OF CORRECTION

PATENT NO. : 8,453,989 B2
APPLICATION NO. : 12/680431
DATED : June 4, 2013
INVENTOR(S) : Kunishita et al.

It is certified that error appears in the above-identified patent and that said Letters Patent is hereby corrected as shown below:

Title page,

Item (73) Assignee: "Uhchida Yoko Co., Ltd." should read --Uchida Yoko Co., Ltd.--.

Signed and Sealed this
Seventeenth Day of September, 2013

Teresa Stanek Rea
*Deputy Director of the United States Patent and Trademark Office*